US006223405B1

(12) United States Patent
Oikawa et al.

(10) Patent No.: US 6,223,405 B1
(45) **Date of Patent: *May 1, 2001**

(54) METHOD OF MANUFACTURING INK JET HEAD

(75) Inventors: Koichi Oikawa; Jun Kodama; Akira Iwaishi; Masayuki Kato; Tomohisa Shingai; Yuji Yoshida; Kazuki Ogawa; Ryosuke Yabu; Isao Mizobuchi; Masahiro Nagai, all of Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/926,023

(22) Filed: Sep. 9, 1997

(30) Foreign Application Priority Data

Dec. 17, 1996 (JP) ..... 8-337208

(51) Int. Cl.[7] ..... H04R 17/00; B41J 2/025

(52) U.S. Cl. ..... 29/25.35; 29/890.1; 29/852; 347/68; 216/27; 205/122

(58) Field of Search ..... 29/890.1, 25.35, 29/831, 852; 347/68, 70, 71, 72; 216/27; 205/122, 150

(56) References Cited

U.S. PATENT DOCUMENTS

| | | | | |
|---|---|---|---|---|
| 4,471,363 | | 9/1984 | Hanaoka | 347/70 |
| 4,752,788 | * | 6/1988 | Yasuhara et al. | 347/70 |
| 5,144,342 | * | 9/1992 | Kubota | 347/68 |
| 5,163,177 | * | 11/1992 | Komura | 29/890.1 |
| 5,185,055 | * | 2/1993 | Temple et al. | 216/27 |
| 5,459,501 | | 10/1995 | Lee et al. | 347/68 |
| 5,463,414 | * | 10/1995 | Temple et al. | 347/68 |
| 5,465,108 | | 11/1995 | Fujimoto | 347/68 |
| 5,471,231 | | 11/1995 | Hiraishi et al. | 347/68 |
| 5,539,982 | * | 7/1996 | Hosono et al. | 29/890.1 |
| 5,598,196 | * | 1/1997 | Braun | 29/25.35 |
| 5,738,799 | * | 4/1998 | Hawkins et al. | 216/27 |
| 5,758,396 | * | 6/1998 | Jeon et al. | 29/25.35 |
| 5,801,731 | * | 9/1998 | Takahashi | 347/71 |
| 5,818,481 | * | 10/1998 | Hotomi et al. | 347/68 |
| 5,844,587 | * | 12/1998 | Ando et al. | 347/71 |
| 5,856,837 | * | 1/1999 | Kitahara et al. | 347/70 |

FOREIGN PATENT DOCUMENTS

| | | |
|---|---|---|
| 36 88 356 T2 | 10/1986 | (DE) . |
| 44 29 904 A1 | 3/1995 | (DE) . |
| 0 692 384 A2 | 1/1996 | (EP) . |
| 0 723 866 A1 | 7/1996 | (EP) . |
| 62-56150 | 3/1987 | (JP) . |
| 3-227247 | 10/1991 | (JP) . |
| 6-218921 | 8/1994 | (JP) . |
| 8-309979 | 11/1996 | (JP) . |

* cited by examiner

*Primary Examiner*—Lee Young
*Assistant Examiner*—A. Dexter Tugbang
(74) *Attorney, Agent, or Firm*—Armstrong, Westerman, Hattori, McLeland & Naughton, LLP

(57) ABSTRACT

A method of manufacturing an ink jet head includes the following steps, wherein the ink jet head is provided with a plurality of pressure chambers arranged continuously, ink feed means for feeding ink into these pressure chambers, and ink ejecting means for ejecting ink from each pressure chamber via a nozzle, so as to feed and eject ink by a change in volume of each pressure chamber. First, a first metallic film is formed on both surfaces of at least one wall composing the pressure chamber perpendicular to an arranging direction of the plurality of pressure chambers, wherein the at least one wall is one wall of a piezoelectric element deformed when a voltage is impressed. Then, the first metallic film formed on one of the both surfaces of at lest one wall is removed to form an exposed surface of the wall of the piezoelectric element. Thereafter, a second metallic film is formed on the exposed surface, whereby metallic films, thicknesses of which are different from each other, are formed on the both surfaces of at least one wall of the piezoelectric element.

6 Claims, 12 Drawing Sheets

PLATING UNDERLAYER

FILLING SLITS WITH WAX

COATING RESIST

REMOVING WAX AND PLATING THICK LAYER

METHOD OF MANUFACTURING INK JET HEAD

BACKGROUND OF THE INVENTION

1. Field of the Invention

The present invention relates to an ink jet type printer used for a recording apparatus such as a printer, a copier or facsimile to record characters and images. More particularly, the present invention relates to an ink jet head in which the deformation of a piezoelectric element is used for a drive source to drive an ink jet pump.

Recently, printers are indispensable for attaining office automation. Moreover, printers are coming widely into private use. As a printer for private use, the ink jet type printer attracts the attention of users because, compared with a wire drive type printer in which printing is conducted on a sheet of paper by pressing a wire against a platen via an ink ribbon, the ink jet type printer in which an ink jet head is used is advantageous in that: it makes little noise; the printing speed is relatively high; and the printing cost per sheet of paper is low.

2. Description of the Related Art

A pump to eject liquid by using the deformation of a piezoelectric element is characterized in that the speed of response is high. Therefore, it is possible to compose a pump having no valves. For the above reasons, the pump in which the deformation of a piezoelectric element is used is preferably applied to an ink jet head which must be compact and free of maintenance. When the passages for ink in the pump are designed in such a manner that the resistance and length on the input side are different from the resistance and length on the output side, ink is ejected onto the side of a short passage in the case of a quick contraction, and only a small quantity of ink is ejected onto the side of a long passage because of a delay in response. Successively, when a slow expansion is conducted in the pump, a difference is caused between a quantity of ink flowing into the short passage and that flowing into the long passage because the cross-sectional area of the short passage and that of the long passage are different from each other. Accordingly, it is possible to form a flow of ink which flows in one direction as a whole.

In the ink jet operation, when the pressure chamber is expanded, the outwards of a nozzle from which ink is ejected is exposed to the atmosphere. Therefore, atmospheric air is prevented from flowing into the pressure chamber via the nozzle by the action of surface tension generated on the atmosphere side of the nozzle. Accordingly, ink flows into the pressure chamber only from the feed passage, that is, the flow of ink has a strong directivity. As a body to drive the pump in this way in which a ratio of the ink flowing speed on the input side to that on the output side is high, a piezoelectric element is preferably used. Especially, the deformation of a piezoelectric element in the thickness direction can respond very quickly, that is, it can respond to a signal, the frequency of which is in the order of MHz, so that the piezoelectric element can be used as an ultrasonic oscillator.

In the case of a conventional ink jet head in which a piezoelectric element is used, only an expansion and contraction in the direction of polarity caused by the piezoelectric effect of the piezoelectric element is used as a means for pressurizing ink by changing a volume of the pressure chamber, or only an expansion and contraction in the perpendicular direction is used. Alternatively, in the conventional ink jet head, only a shearing deformation of the piezoelectric effect is used. In other words, only one direction of deformation caused by the piezoelectric effect is used as a means for pressurizing ink.

Concerning the deformation of a piezoelectric element, the direction of polarization is referred to as $d_{33}$, and the direction perpendicular to the direction of polarization is referred to as $d_{31}$. Concerning the deformation of a piezoelectric element, the piezoelectric constant $d_{33}$ is $650\times10^{-12}$ m/V at the most. Irrespective of the thickness of the piezoelectric element, even when the voltage is set at 100 V, an amount of expansion is approximately 70 nm. Accordingly, unless an area of the wall of the piezoelectric element to determine the pressure chamber is very large, the contracting volume of the pump is very small. That is, an amount of deformation is described as follows. When voltage E is impressed upon the piezoelectric element in the direction of polarization and the thickness of the piezoelectric element in that direction is t, the electric field intensity is E/t, and the deformation in the thickness direction (the direction of polarization) caused by that is expressed by the following equation.

$$(E/t)\times d_{33}\times t=Ed_{33}$$

However, when the piezoelectric effect is provided by a piezoelectric element, an expansion and contraction and a shearing are caused in a plurality of directions. Accordingly, from the viewpoint of enhancing the efficiency of using energy, it is not advantageous that one of these deformations is used alone, but it is advantageous that the deformations are used while they are compounded with each other. When these deformations of a piezoelectric element are used while they are compounded with each other, even in the case of impressing a low voltage, it is possible to obtain a change in the volume of the pressure chamber, the amount of which is the same as that of the present ink jet head, and further the expense necessary for an electric power supply to drive the ink jet head can be reduced.

In view of the above circumstances, it is possible to compose an ink jet head of high energy efficiency when an expansion and contraction in the direction of $d_{33}$, which is a direction of polarity provided by the piezoelectric effect of a piezoelectric element, is compounded with an expansion and contraction in the direction of $d_{31}$, which is a direction perpendicular to the direction of polarity provided by the piezoelectric effect. When a voltage is impressed upon the piezoelectric element so as to contract the piezoelectric element in the direction of $d_{31}$, the piezoelectric element is expanded in the direction of $d_{33}$. Accordingly, one of these behaviors which are opposed to each other is utilized as a cause of the bimorph effect generated in a compound member composed of the piezoelectric element and a member made of material different from the material of the piezoelectric element. That is, ink is pressurized by superimposing a deformation caused by the piezoelectric effect of the piezoelectric element itself on a deformation caused by the bimorph effect generated in the compound member made of material different from material of the piezoelectric element.

When the plate-shaped piezoelectric element (activated section) is made to adhere to the unactivated section made of material different from material of the piezoelectric element, the piezoelectric element is expanded in the thickness direction, and at the same time it is contracted in the surface direction. Accordingly, a strain is caused between the piezoelectric element and the unactivated section. Due to the generation of strain, camber is caused so as to relieve the strain.

FIGS. 1 and 2 are views showing this concept. In FIGS. 1 and 2, reference numeral 1 is a compound plate-shaped member, reference numeral 2 is an activated section composed of a piezoelectric element, reference numeral 3 is an unactivated section, and reference numeral 4 is a stationary wall. The radius of curvature of the camber is larger on the unactivated section side (thickness $h_1$) and smaller on the activated section side (thickness $h_2$) which is located inside. Accordingly, the length of the unactivated section in the surface direction is a little different from the length of the activated section in the surface direction. Due to the foregoing, strain δ of the piezoelectric element is greatly changed. This principle has been applied to an ink jet mechanism for some time. However, application of this principle is restricted for the following several reasons.

(1) In order to increase a ratio of magnification, it is advantageous to use a thin piezoelectric element. However, it is difficult to form a thin piezoelectric element.

(2) When the thickness of a piezoelectric element is reduced, it is possible to extend a strain volume. However, the rigidity is lowered, and it becomes impossible to generate a high pressure, that is, it is impossible to provide a sufficiently high ink ejecting pressure.

(3) It is necessary to increase an activating area of the piezoelectric element. However, since restricted by the construction, only one surface of the piezoelectric element is driven. Therefore, ejection of ink deviates due to the unbalance of the activating area of the piezoelectric element.

On the other hand, in the case of an ultrasonic oscillator in which only a change in the thickness of the piezoelectric element is used, the rigidity is high, so that it is possible to generate a high pressure, however, a change in the volume is small. Accordingly, it is necessary to provide a wall of large area to be used as an activating surface.

SUMMARY OF THE INVENTION

Accordingly, it is an object of the present invention to provide an ink jet head of high energy efficiency capable of providing a sufficiently high ink ejecting pressure when an expansion and contraction of the piezoelectric element in a direction of the polarization $d_{33}$ caused by the piezoelectric effect is appropriately compounded with an expansion and contraction of the piezoelectric element in a direction of $d_{31}$ perpendicular to the direction of the polarization $d_{33}$ and also when the bimorph effect is utilized which is obtained by a compound member composed of the piezoelectric element and another member made of material different from the material of the piezoelectric element.

The present invention is to provide an ink jet head comprising: a plurality of pressure chambers arranged continuously; an ink feed means for feeding ink into these pressure chambers; and an ink ejecting means for ejecting ink from each pressure chamber via a nozzle, wherein ink is fed and ejected by a change in the volume of each pressure chamber, at least one of the walls composing the pressure chamber arranged perpendicular to the arranging direction of the plurality of pressure chambers is composed of a compound plate-shaped member in which an activated section made of a piezoelectric element deformed by the impression of a voltage is joined to an unactivated section made of material different from material of the activated section, the unactivated section includes an electrode to impress a voltage upon the piezoelectric element in the activated section, and the compound plate-shaped member causes a change in the volume of each pressure chamber when it is curved and deformed by the bimorph effect generated between the activated section and the unactivated section.

As described above, according to the present invention, the bimorph effect is provided when the activated section composed of a piezoelectric element is joined to the unactivated section made of material different from material of the piezoelectric element. Therefore, the energy efficiency is high, and it is possible to produce a sufficiently high ink ejecting pressure.

The pressure chamber includes: a compound plate-shaped member composing at least one wall; an opposing wall opposed in parallel to the compound plate-shaped member; a stationary wall to close tightly one side of the pressure chamber space defined by the compound plate-shaped member and the opposing wall; and a connecting member to close tightly the other side of the pressure chamber space.

There are provided a pair of compound plate-shaped members opposed to each other, arranged perpendicular to the direction of arrangement of the plurality of pressure chambers. Each pressure chamber is defined by the pair of compound plate-shaped members. Each compound plate-shaped member is composed of an activated section made of a piezoelectric element deformed by the impression of a voltage, and an unactivated section made of material different from material of the activated section, wherein the unactivated section includes an electrode by which a voltage is impressed upon the piezoelectric element in the activated section. The compound plate-shaped member is curved and deformed by the bimorph effect caused between the activated section and the unactivated section. The deformation of one of the compound plate-shaped members is opposite to the deformation of the other of the compound plate-shaped members.

In this case, the pressure chamber includes: a pair of compound plate-shaped members; a stationary wall to close tightly one side of the pressure chamber defined by the pair of compound plate-shaped members; and a connecting member to close tightly the other side of the pressure chamber.

The pair of plate-shaped members act in such a manner that the deformation of one plate-shaped member is added to or subtracted from the deformation of the other plate-shaped member. Due to the foregoing, the deformation of the piezoelectric element generated by strain is magnified, so that the contraction and expansion of the pressure chamber can be magnified.

In this connection, in order to realize the bimorph effect, a conductor to impress a voltage upon the piezoelectric element may be used as the material different from the material of the activated section, that is, as material of the unactivated section. In order to generate the bimorph effect, the characteristic of the material different from the material of the piezoelectric element is determined as follows.

$$E_1 \leq E_2$$

where $E_1$ ($N/m^2$) is a modulus of longitudinal elasticity of the piezoelectric element composing the curved wall (the activated section), and $E_2$ ($N/m^2$) is a modulus of longitudinal elasticity of the material (the unactivated section) different from the material of the piezoelectric element.

The specific structure to realize the bimorph effect is described as follows. There is provided an unactivated section on one of the surfaces of the piezoelectric element, which is an activated section, in the polarity direction upon which a voltage is impressed. On the other side, there is provided an unactivated section layer which is sufficiently thinner than the unactivated section on one surface described above, or alternatively there is provided no unactivated section. Due to the above structure, in the deformation in the direction of $d_{31}$ caused by the piezoelectric effect of the activated section, the influence of the thick unactivated section becomes stronger than the influence of the thin unactivated section, or alternatively the influence of the existing unactivated section becomes stronger than the influence of the non-existing unactivated section. In this way, the structure of the compound plate-shaped member including the activated section (piezoelectric element) and the unactivated section can be determined.

Since the contraction of the unactivated section is more difficult to produce than the contraction of the piezoelectric element in the direction of $d_{31}$, when the piezoelectric element is deformed in the direction of $d_{31}$, the bimorph effect is caused in the compound plate-shaped body by these two members. Accordingly, when both the bimorph effect, which is caused by the deformation in the direction of $d_{31}$ generated by the piezoelectric effect of the piezoelectric element, and the deformation of the piezoelectric element in the thickness direction, which is caused by the deformation in the direction of $d_{33}$ generated by the piezoelectric effect of a piezoelectric element, are applied onto one wall surface of the pressure chamber, it becomes possible to utilize both the piezoelectric effect and the bimorph effect of the piezoelectric element for pressurizing ink.

In this connection, when a member (unactivated section) made of material different from material of the piezoelectric element (activated section) is put on the piezoelectric element (activated section) in the direction of $d_{33}$ so as to compose a compound plate-shaped member wherein one end of the compound plate-shaped member is fixed and the other end is put in a free boundary condition, radius of curvature ρ (m) to express the deformation caused by the bimorph effect in the case of fixing one end can be represented by the following equation.

$$\rho = \frac{h_1}{d_{31} \cdot \frac{V}{h_1}} \cdot \frac{\frac{\alpha^4}{\beta} + 2\alpha \cdot (2\alpha^2 + 3\alpha + 2) + (3\alpha^4 - 6a^2 + 4) \cdot \beta}{6\alpha \cdot (\alpha + 1)}$$

In the above expression, α is a reciprocal $h_2/h_1$ of the ratio of the thickness $h_1$ (m) of the piezoelectric element to the thickness $h_2$ (m) of the member made of different material necessary for realizing the bimorph effect, β is a ratio $E_1/E_2$ of the modulus of longitudinal elasticity $E_1$ ($N/m^2$) of the piezoelectric element to the modulus of longitudinal elasticity $E_2$ ($N/m^2$) of the different material necessary for realizing the bimorph effect, V (V) is a voltage to be impressed upon the piezoelectric element, and $d_{31}$ (m/V) is a piezoelectric constant of the piezoelectric element in the direction of $d_{31}$.

If a ratio of the thickness of the unactivated section to the thickness of the activated section (piezoelectric element) is set a value at which the radius of curvature ρ (m) can be made small, a displacement volume is increased by curving the piezoelectric element, the lower end of which is fixed and the movement of the upper end of which is restricted. Accordingly, when the piezoelectric element is formed into a compound plate-shaped member, the displacement efficiency of the piezoelectric element is increased. When a value of $h_2/h_1$ to minimize the radius of curvature ρ (m) obtained by the above equation is calculated using physical property of a usable material, the following expression can be provided.

$$0.3 \leqq h_2/h_1 \leqq 0.8$$

Therefore, a relation between the thickness $h_1$ (m) of the piezoelectric element and the thickness $h_2$ (m) of the unactivated section necessary for realizing the bimorph effect is determined by the above expression.

When a period to eject ink is represented by x (Hz), the wave-form of a voltage to be impressed upon the piezoelectric element is based on the period. Therefore, in order to avoid the occurrence of a mechanical resonance state of the compound plate-shaped member provided to realize the bimorph effect, the characteristic frequency f (Hz) of the compound plate-shaped member itself must be at least 3 times as high as the period x (Hz) of ejection of ink. Accordingly, the dimensions and values of physical property of the compound plate-shaped member are determined by the following expressions so that the above relation can be satisfied.

$$E_1 \cdot h_1^2/\gamma_1 \cdot L^4 \geqq 345 \cdot x^2$$

$$E_2 \cdot h_2^2/\gamma_2 \cdot L^4 \geqq 345 \cdot x^2$$

In the above expressions, the modulus of longitudinal elasticity of the activated section (piezoelectric element) is $E_1$ ($N/m^2$), the density is γ1 ($kg/m^3$), the modulus of longitudinal elasticity of the unactivated section is $E_2$ ($N/m^2$), the density is γ2 ($kg/m^3$), the length from the stationary portion to the connecting member in the direction of $d_{31}$ of the piezoelectric element is L (m), the thickness of the piezoelectric element is $h_1$ (m), and the thickness of the member to be joined is $h_2$ (m).

When the thickness of the pressure chamber composed of the activated section (piezoelectric element) and the unactivated section is represented by h (m), in order to prevent the cancellation of the displacement of the piezoelectric element by the influence of a desired generated pressure, the dimensions and values of physical property of the piezoelectric element are determined so that the following expression can be satisfied.

$$L^5 \cdot b/h^3 \leqq (4 \times 10^{-18}) \cdot E_1$$

In the above expression, b (m) is a depth of the piezoelectric element in the direction perpendicular to both directions of the length L (m) and the thickness h (m) of the piezoelectric element.

In this structure, the compound plate-shaped member and the connecting member are joined to each other with adhesive or dry film resist. However, when one pressure chamber is strongly joined to the compound plate-shaped member of the other pressure chamber which is adjacent to the above pressure chamber, ink ejection from one pressure chamber is affected by the deformation of the compound plate-shaped member of the other pressure chamber which is adjacent to the above pressure chamber. Therefore, in order to reduce the joining strength between the pressure chamber and the compound plate-shaped member adjacent to the pressure chamber, one portion or all portions of the joining member to be connected with the pressure chamber are separated. In this structure, when the restriction of the piezoelectric element on the side which is not fixed is too strong or weak, the efficiency of deformation is deteriorated. Therefore, the modulus of longitudinal elasticity $E_4$ ($N/m^2$) of adhesive used for joining a plurality of compound plate-shaped members (walls) to the connecting member is determined so that it can satisfy the following expression.

$$1.0 \times 10^9 \leqq E_4 \leqq 10.0 \times 10^9$$

In order to enhance the efficiency, the thickness $h_4$ ($\mu$m) of the member to join the piezoelectric element to the connecting member is determined so that the following expression can be satisfied.

$$10 \leqq h_4 \leqq 100$$

It is possible to form an activated section of the piezoelectric element composed of a pair of compound plate-shaped members and also to form the aforementioned stationary wall by means of forming grooves in one integrated block of the piezoelectric element.

Consideration is given as follows. It is necessary that the piezoelectric element can endure the pressure generated when ink is pressurized, and also it is necessary that a predetermined quantity of ink can be ejected. Further, consideration is given to the limit which must be established when the machining of a groove formation is realized. According to the above consideration, the length L (m) from the stationary wall to the connecting member in the direction of $d_{31}$ of the activated section (piezoelectric element) is determined so that the following expression can be satisfied.

$$300\times10^{-6} \leqq L \leqq 700\times10^{-6}$$

From the same viewpoint as described above, the thickness $h_1$ (m) of the activated section (piezoelectric element) is determined so that the following expression can be satisfied.

$$20\times10^{-6} \leqq h_1 \leqq 80\times10^{-6}$$

The present invention is to provide an ink jet head comprising: a plurality of pressure chambers arranged continuously; an ink feed means for feeding ink into these pressure chambers; and an ink ejecting means for ejecting ink from each pressure chamber via a nozzle, wherein ink is fed and ejected by a change in the volume of each pressure chamber, a stationary wall parallel with the arranging direction of the plurality of pressure chambers and a pair of side walls opposed to each other perpendicular to the stationary wall are formed by an integrated member composed of a piezoelectric element, a film of the unactivated section including an electrode is joined to the surfaces of the pair of side walls to be formed into the activated section so that a pair of compound plate-shaped members are formed, a space of the pressure chamber is defined by the stationary wall and the pair of compound plate-shaped members, a space is defined between the pressure chamber and the adjacent pressure chamber, each compound plate-shaped member is curved and deformed by the bimorph effect caused between the film of the activated section and the film of the unactivated section, and the thus caused deformation is activated in the opposite direction with respect to the two compound plate-shaped members opposed to each other so as to generate a change in the volume of each pressure chamber.

As described above, when the integrated piezoelectric element is subjected to groove forming, the groove to define the pressure chamber can be formed, and also the groove to define the space between the units can be formed. By means of plating, the electrode, that is, the unactivated section of the conductor can be formed on the wall (activated section) of the piezoelectric element to define the pressure chamber.

In this case, it is characterized in that the value of $h_2E_2/h_1E_1$ is not less than 0.05, wherein $h_1$ is a thickness of the activated section composing the compound plate-shaped body, $h_2$ is a thickness of the unactivated section, $E_1$ is a modulus of longitudinal elasticity of the activated section, and $E_2$ is a modulus of longitudinal elasticity of the unactivated section.

It is characterized in that: a first metallic film is formed on a surface of one of the pair of side walls, so that the first metallic film is used as an unactivated layer; a second metallic film, the thickness of which is different from that of the first metallic film, is formed on the other of the pair of side walls, so that the second metallic film is used as an unactivated layer; and the bimorph effect is provided between the activated layer of the piezoelectric element and the unactivated layer by the difference of thickness between both unactivated layers. These first and the second metallic film function as an electrode through which a voltage can be impressed upon the activated section composed of a piezoelectric element.

In this case, the following arrangement may be adopted. Thickness of the unactivated layer provided inside the pressure chamber is made to be large, and thickness of the unactivated layer provided outwards the pressure chamber is made to be small. By injecting an electric charge between both the unactivated layers, a volume of the pressure chamber is reduced. When the volume of the pressure chamber is reduced, ink is ejected from a nozzle communicated with the pressure chamber.

On the contrary, the following arrangement may be adopted. Thickness of the unactivated layer provided inside the pressure chamber is made to be small, and thickness of the unactivated layer provided outwards the pressure chamber is made to be large. By injecting an electric charge between both the unactivated layers, the volume of the pressure chamber is increased. When the volume of the pressure chamber is increased, ink is fed into the pressure chamber. When the impressed voltage is released, the volume of the pressure chamber is reduced. At this time, ink is ejected from the nozzle.

The present invention is to provide a method of manufacturing an ink jet head provided with: a plurality of pressure chambers arranged continuously; an ink feed means for feeding ink into these pressure chambers; and an ink ejecting means for ejecting ink from each pressure chamber via a nozzle, so as to feed and eject ink by a change in the volume of each pressure chamber, the method of manufacturing an ink jet head comprising the steps of: forming a first metallic film on at least one wall composing the pressure chamber perpendicular to the arranging direction of the plurality of pressure chambers, wherein the wall is one wall of the piezoelectric element deformed when a voltage is impressed; exposing the piezoelectric element by machining one of the surfaces of the wall onto which metal has adhered; and forming a second metallic film on the exposed surface, whereby metallic films, the thicknesses of which are different from each other, are formed on both surfaces of the wall of the piezoelectric element. Thicknesses of the metallic films provided on both sides of the wall composed of the piezoelectric element are different from each other. Therefore, the bimorph effect can be surely caused.

The present invention is to provide a method of manufacturing an ink jet head provided with: a plurality of pressure chambers arranged continuously; an ink feed means for feeding ink into these pressure chambers; and an ink ejecting means for ejecting ink from each pressure chamber via a nozzle, so as to feed and eject ink by a change in the volume of each pressure chamber, the method of manufacturing an ink jet head comprising the steps of: forming a plurality of parallel grooves, by which the pressure chamber is defined, on the block of the piezoelectric element; conducting a first plating on the inside of the grooves; forming a plurality of grooves, by which a space is defined, between the grooves to define the pressure chamber; and conducting a second plating on the inside of the grooves, whereby metallic films, the thicknesses of which are different from each other, are formed on both surfaces of the wall of the pressure chamber.

In this case, after the grooves to define the pressure chamber have been formed, in order to prevent an upper surface of the block of the piezoelectric element from being plated, the grooves may be covered with a cover capable of being removed later, and the first plating may be conducted. After the completion of the first plating, the cover may be removed.

After the completion of the second plating, in order to electrically shut off the unit from the adjacent unit, further smaller grooves may be formed in the grooves to define the space chamber.

The present invention is to provide a method of manufacturing an ink jet head provided with: a plurality of pressure chambers arranged continuously; an ink feed means for feeding ink into these pressure chambers; and an ink ejecting means for ejecting ink from each pressure chamber via a nozzle, so as to feed and eject ink by a change in the volume of each pressure chamber, the method of manufacturing an ink jet head comprising the steps of: forming a first groove to define the pressure chamber in the piezoelectric block and a second groove to define a space chamber, wherein the first and the second groove are alternately formed in parallel with each other; plating the first and the second groove, wherein thickness of the plated layer is small; filling one of the first and the second groove with removable filling; covering the entire surface with resist; removing the filling; and plating the first and the second groove, wherein thickness of the plated layer is large, so that metallic films of different thickness are formed on both surfaces of the side wall of the pressure chamber.

In this case, electroplating is conducted in at least one portion of the plating process in which a thick metallic layer is formed, so that the thickness of the plated layer at the edge portion of the side wall of the pressure chamber is smaller than the thickness of the plated layer at the center. Due to the foregoing, the deformation resistance at the corner portion of the piezoelectric element can be decreased, and the bimorph effect can be effectively utilized for the expansion and contraction of the pressure chamber.

BRIEF DESCRIPTION OF THE DRAWINGS

FIG. 7(*b*) is a view showing a state in which the pressure chamber is formed by grooving;

FIG. 12(*b*) is a view showing a process of forming an electrode by means of plating;

FIG. 13(*b*) is a view showing a process in which the pressure chamber is filled with filling;

FIG. 13(*c*) is a view showing a process in which the pressure chamber is covered with resist by means of plating;

FIG. 13(*d*) is a view showing a process of thick-plating conducted by means of electroless plating on the inside of the pressure chamber from which filling has been removed;

FIG. 14(*b*) is a view showing a process in which the pressure chamber is filled with filling;

FIG. 14(*c*) is a view showing a process in which the pressure chamber is covered with resist by means of plating;

FIG. 14(*d*) is a view showing a process of thick-plating conducted by means of electroplating on the inside of the pressure chamber from which filling has been removed.

DETAILED DESCRIPTION OF THE EMBODIMENTS

Figure 1:
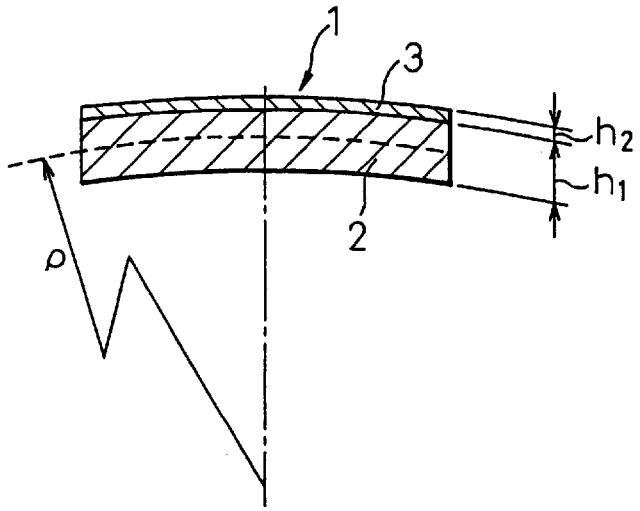
Fig.1 (Prior Art)
FIG. 1 is a view showing circumstances in which a piezoelectric element is contracted in the surface direction so that the piezoelectric element is curved due to a difference of strain between the piezoelectric element and the thick electrode.
Figure 2:
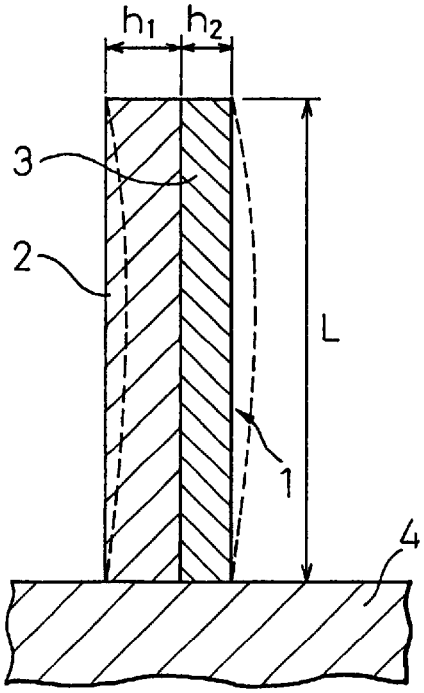
Fig.2 (Prior Art)
FIG. 2 is a view showing a state in which the piezoelectric element (activated section) and the unactivated section made of different material are joined to each other so as to form a compound plate-shaped member.
Figure 3:
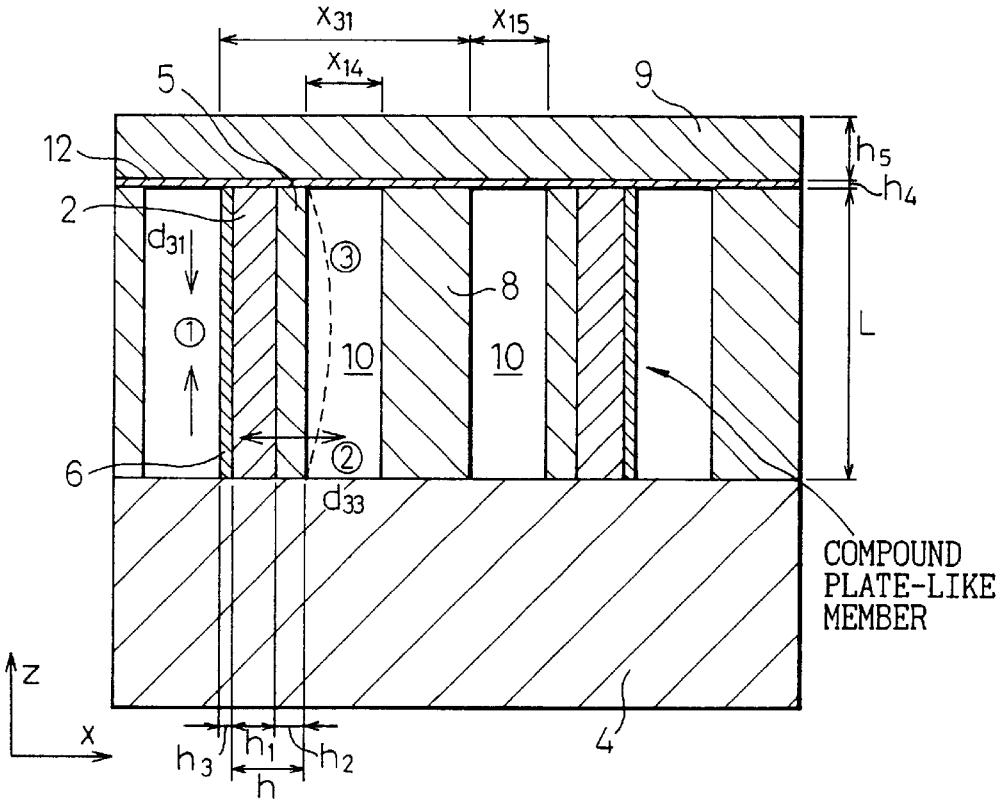
FIG. 3 is a cross-sectional view showing a primary portion (pressure chamber) of the first example of the ink jet head of the present invention.

FIG. 3 is a cross-sectional view showing a primary portion (pressure chamber) of the first example of the ink jet head of the present invention.

As illustrated in FIG. 3, there are provided a large number of pressure chambers 10 in the direction x. Although not illustrated in FIG. 3, each pressure chamber is communicated with a nozzle through which ink is ejected from the pressure chamber 10, and also communicated with an ink feed port through which ink is fed into this pressure chamber. There is provided a compound plate-shaped member 1 by which one wall of the pressure chamber is defined. The compound plate-shaped member 1 is composed in such a manner that conductors (unactivated layers) 5, 6, which are used as electrodes, are joined onto both sides of a piezoelectric element (activated layer) 2.

This compound plate-shaped member 1 defines one wall of the pressure chamber 10. The direction of polarization of the piezoelectric element 2 is the same as the direction of x. The direction of polarization of the piezoelectric element 2 is uniform with respect to one wall. This direction x of polarization is perpendicular to the surfaces of the electrodes 5, 6. The electrode 5 arranged inside the pressure chamber 10 is thick, and the electrode 6 arranged outwards the pressure chamber 10 is thin. When these members are incorporated into the compound plate-shaped member 1, two factors of the piezoelectric element (activated layer) 2 and the thick electrode 5 govern the mode of deformation.

As can be seen in FIG. 3, the pressure chamber 10 is defined as a space surrounded by the stationary wall 4 extending in the direction x, the compound plate-shaped member 1 extending in the direction z perpendicular to the direction x, the unactivated opposing wall 8 opposed to this compound plate-shaped member 1 in parallel and a connecting member 9 closing the upper opening portion. The connecting member 9 is fixed to the compound plate-shaped member 1 and the opposing wall 8 by an adhesive member or an adhesive agent.

The opposing wall 8 also functions as a wall portion of the adjacent pressure chamber 10. The adjacent pressure chamber 10 is also defined by the opposing wall 8 and the adjacent compound plate-shaped member 1. In the same manner as described above, on this adjacent compound plate-shaped member 1, the electrode 5 arranged inside the pressure chamber 10 is thick, and the electrode 6 arranged outwards the pressure chamber 10 is thin.

Figure 4:
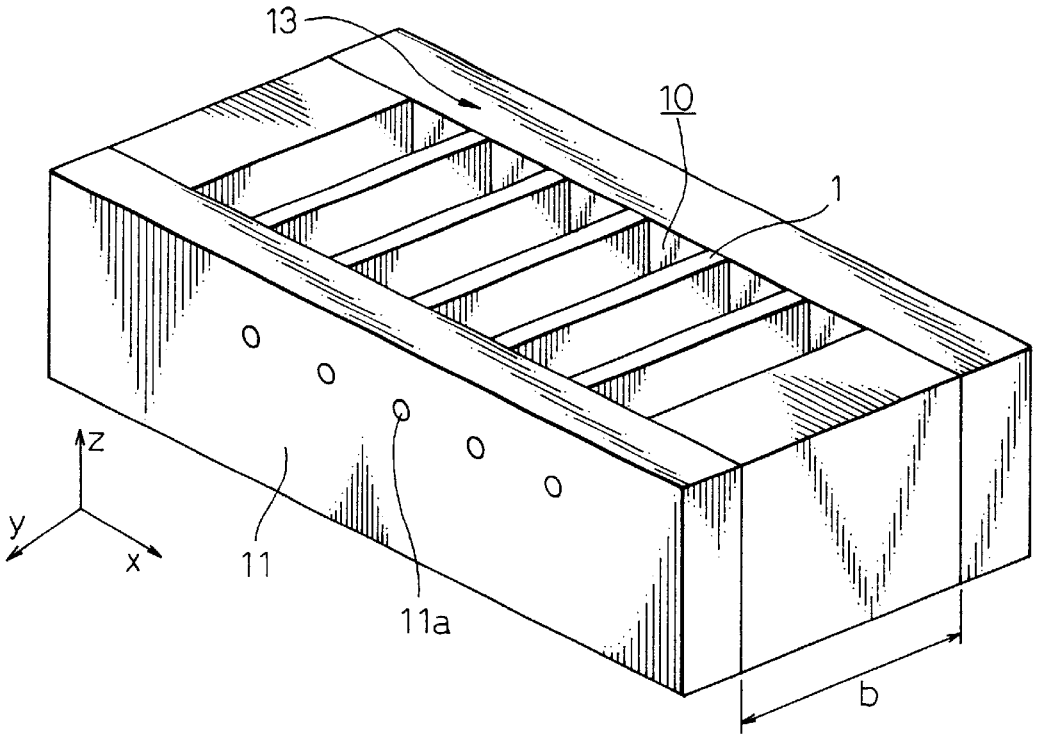
FIG. 4 is a perspective view showing a state in which the connecting member is removed from the ink jet head of the first example.

FIG. 4 is a perspective view showing a portion of the pressure chamber of the ink jet head illustrated in FIG. 3, wherein the connecting member is removed from the pressure chamber in this view. As illustrated in FIG. 4, there is provided a nozzle plate 11 which is arranged in such a manner that one side of a large number of pressure chambers 10 arranged in the direction x is closed by the nozzle plate 11. In this arrangement, each nozzle 11*a* corresponds to each pressure chamber 10. The other side of the pressure chamber 10 with respect to the nozzle plate 11 is closed up by an end plate 13 on the ink feed side. On this end plate 13, there are formed ink feed ports (not shown) from which ink is fed into the pressure chambers 10.

Referring to FIG. 3, operation of the first example of the present invention will be explained below. As illustrated in FIG. 3, the compound plate-shaped member 1 is composed of a piezoelectric element 2 which is an activated section, and electrodes 5, 6 which are unactivated sections. In this arrangement, a voltage is impressed between the electrodes 5 and 6.

When a voltage is impressed upon the piezoelectric element 2, the piezoelectric element 2 is contracted in the direction z in FIG. 3, that is, the piezoelectric element 2 is contracted in the direction $d_{31}$ (the direction (1) in the drawing), and at the same time, the piezoelectric element 2 is expanded in the direction x, that is, the piezoelectric element 2 is expanded in the direction $d_{33}$ (the direction (2) in the drawing). Since the piezoelectric element 2 is contracted in the direction $d_{31}$, the compound plate-shaped member 1 composed of the thick electrode 5 and the piezoelectric element 2 is deformed by the bimorph effect. This deformation is added to the deformation caused by the piezoelectric effect in the direction 33. Therefore, the compound plate-shaped member 1 is curved as shown by the broken line in the drawing.

Due to the foregoing, the volume in the pressure chamber 10 is decreased, and ink can be ejected from the nozzle. In this arrangement, the compound plate-shaped member 1 and the stationary wall 4 are made of different materials. These materials may be the same, that is, the compound plate-shaped member 1 and the stationary wall 4 may be integrally made of material of the piezoelectric element. In this connection, the stationary wall 4 is an unactivated section. Dimensions of each member are determined as shown on Table 1. Physical properties (moduli of elasticity) of the piezoelectric element, the conductor composing the electrode and the adhesive member are determined as shown on Table 2. Period x in which ink is ejected from the nozzle of the ink jet head is 7.2×10 (Hz), and density γ2 of the piezoelectric element is 8.15×10 (kg/m$^3$).

TABLE 1

| Member | Name | Variable | Unit | Value |
|---|---|---|---|---|
| Piezoelectric body (2) | Thickness | $h_1$ | μm | 60 |
| | Length | L | μm | 450 |
| | Depth | b | mm | 2 |
| Electrode (thick) (5) | Thickness | $h_2$ | μm | 30 |
| Electrode (thin) (6) | Thickness | $h_3$ | μm | 2 |
| Connecting member (8) | Thickness | $h_5$ | μm | 30 |
| Adhesive member (12) | Thickness | $h_4$ | μm | 25 |

TABLE 2

| Member | Variable | Unit | Value |
|---|---|---|---|
| Piezoelectric body | $E_1$ | N/m$^2$ | 6.80E + 10 |
| Conductor | $E_2$ | N/m$^2$ | 2.10E + 11 |
| Adhesive member | $E_4$ | N/m$^2$ | 4.00E + 09 |

When the conditions described on Tables 1 and 2 are satisfied, the following expressions are established.

$$0.3 \leqq \frac{h_2}{h_1} = \frac{30\times10^{-8}}{60\times10^{-8}} = 0.5 \leqq 0.8$$

$$E_1 = 6.8\times10^{10} \leqq E_2 = 2.1\times10^{11}$$

$$\frac{E_1\cdot h_1^2}{\gamma_1\cdot L^4} = \frac{6.8\times10^{10}\times(60\times10^{-8})^2}{8.15\times10^3\times(450\times10^{-8})^4} =$$

$$7.33\times10^{11} \geqq 1.79\times10^{10} = 345\times(7.2\times10^3)^2 = 345\cdot x^2$$

$$\frac{E_2\cdot h_2^2}{\gamma_2\cdot L^4} = \frac{2.1\times10^{10}\times(30\times10^{-8})^2}{8.90\times10^3\times(450\times10^{-8})^4} =$$

$$5.18\times10^{11} \geqq 1.79\times10^{10} = 345\times(7.2\times10^3)^2 = 345\cdot x^2$$

$$\frac{L_5\cdot b}{h^3} = \frac{(450\times10^{-8})^5\times2\times10^{-3}}{(30\times10^{-8}+60\times10^{-8})^3} =$$

$$5.06\times10^{-8} \leqq 2.72\times10^{-7}(4\times10^{-18})\times6.8\times10^{10} = (4\times10^{-18})\cdot E_1$$

$$1.0\times10^8 \leqq E_4 = 4.5\times10^9 \leqq 10.0\times10^0$$

$$10 \leqq h_4 = 25 \leqq 100$$

When the ink jet head is composed as described above, it is possible to provide an ink jet head of high energy efficiency.

Figure 5:
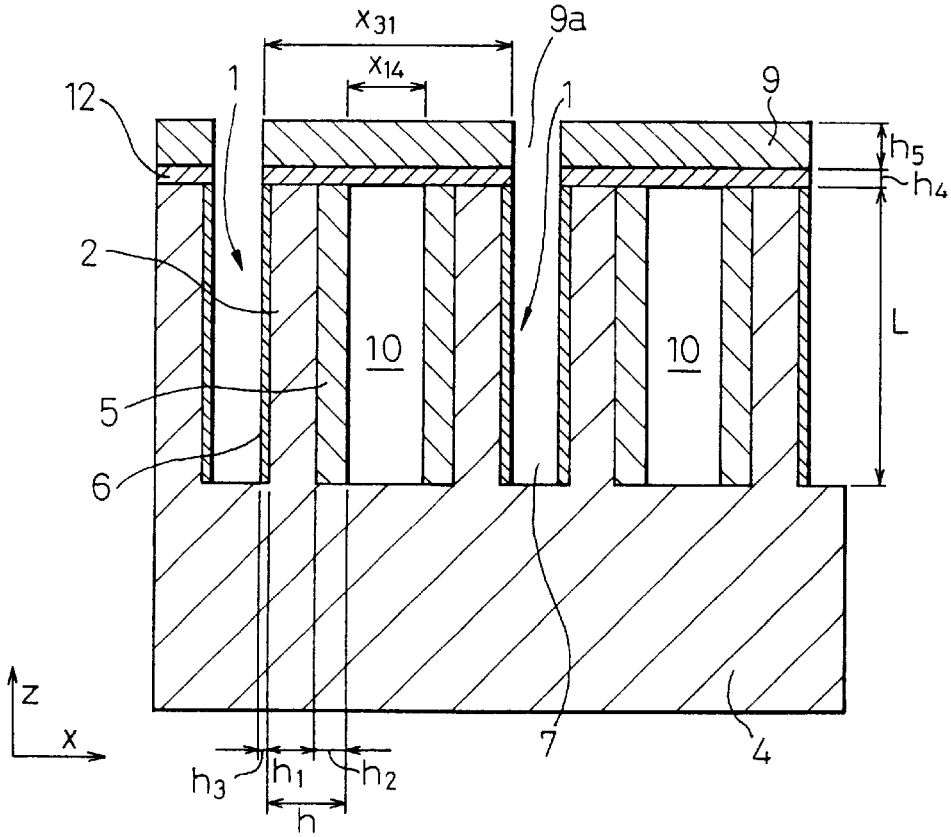
FIG. 5 is a cross-sectional view showing a primary portion (pressure chamber) of the second example of the ink jet head of the present invention.

FIG. 5 is a cross-sectional view showing a primary portion (pressure chamber) of the second example of the ink jet head of the present invention.

Different points from the first example shown in FIG. 3 will be explained below. In the arrangement of the second example, not only the wall on one side of the pressure chamber but also the walls on both sides are composed of the compound plate-shaped member 1. The piezoelectric element 2 which is an activated section of the compound plate-shaped body 1 is integrated with the stationary wall 4, that is, the stationary wall 4 is composed of the piezoelectric element. In the same manner as that described before, each compound plate-shaped member 1 is composed in such a manner that the conductors (unactivated layers) 5, 6 to be used as electrodes are joined to both sides of the piezoelectric element (activated section) 2. The electrode 5 arranged inside the pressure chamber 10 is thick, and the electrode 6 arranged outwards the pressure chamber 10 is thin.

Accordingly, as can be seen in FIG. 5, the pressure chamber 10 is defined as a space surrounded by the stationary wall 4 (the piezoelectric element 2 and the unactivated section) extending in the direction x, a pair of compound plate-shaped members 1 extending in the direction z perpendicular to the direction x, and a connecting member 9 closing the upper opening portion of the pair of compound plate-shaped members 1.

There is formed a space 7 between the compound plate-shaped member 1, which defines the side wall of the pressure chamber 10, and the compound plate-shaped member 1 of the adjacent pressure chamber 10.

Figure 6:
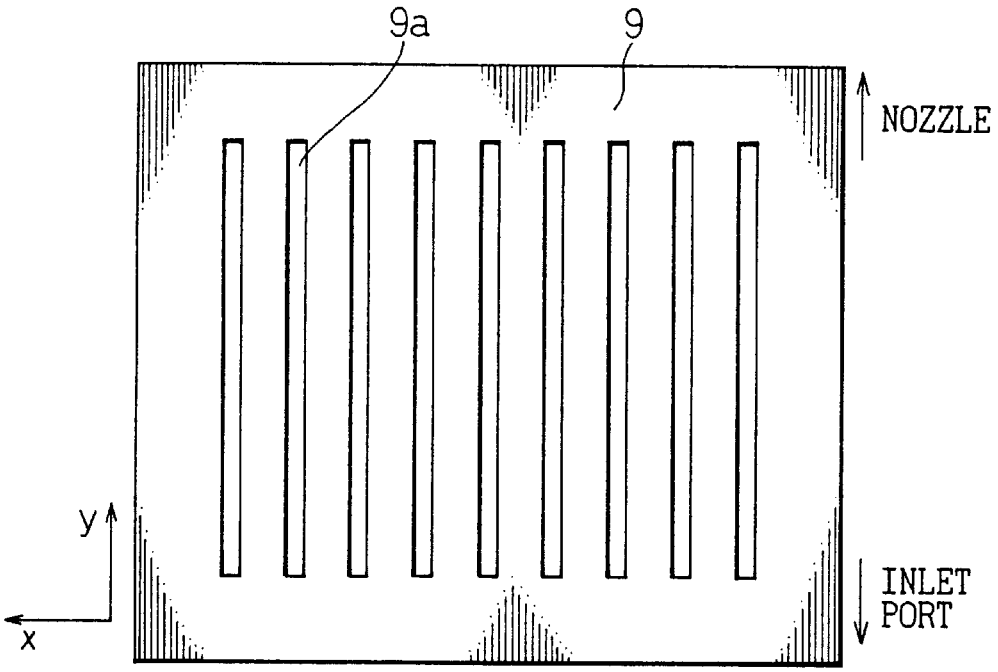
FIG. 6 is a plan view of the connecting member of the ink jet head of the second example.

FIG. 6 is a plan view of the connecting member 9 of the second example, wherein the view is taken in the direction z. This connecting member 9 has grooves (openings) 9*a* located at positions corresponding to the spaces 7 formed between the adjacent pressure chambers 10. That is, the nozzle side of the connecting member 9 is connected with the feed port side of the connecting member 9, and the connecting member 9 is separated by these grooves 16 only in portions corresponding to the spaces 7 formed between the pressure chambers 10. The connecting member 9 has a grid-shaped profile.

Due to the above arrangement, degree of combination attained by the connecting member 9 between the adjacent pressure chambers 10 can be suppressed low. Therefore, the drive condition of the pressure chamber is difficult to affect by the drive condition of the adjacent pressure chamber. The connecting member 9 is joined to the compound plate-shaped member 1 by the adhesive member 12. Dimensions and physical properties of each member of this second example are the same as those shown on Tables 1 and 2. Due to the foregoing, when a voltage of 40 V is impressed upon the piezoelectric element 2 in this arrangement, the displacement volume in the pressure chamber 10 is approximately 60 (pl). Therefore, it is possible to obtain a predetermined displacement volume by a low voltage.

Figure 7A:
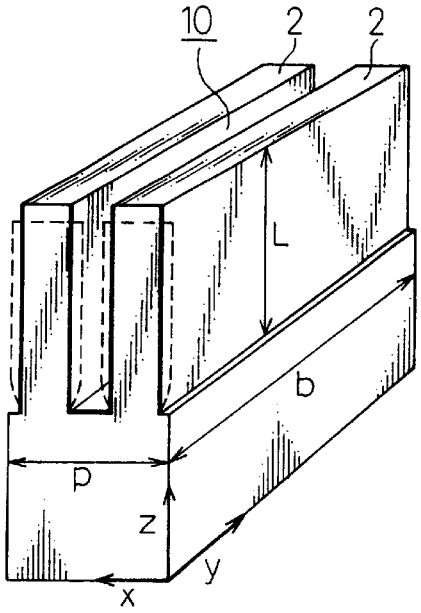
FIG. 7(*a*) is a view showing a piezoelectric element block.
Figure 7B:
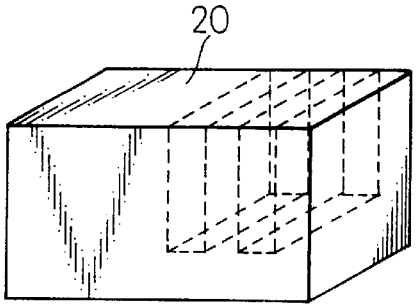

Next, referring to FIGS. 7(*a*) and 7(*b*), the method of manufacturing the ink jet head of the present invention will be specifically explained as follows.

Concerning the piezoelectric element, it is possible to use a piezoelectric element such as H5D manufactured by Sumitomo Metal Industries, Ltd. or C9 manufactured by Fuji Ceramics Co., Ltd. When grooving is conducted on one surface (for example, the upper surface shown in the drawing) of the piezoelectric element block 20 shown in FIG. 7(*b*) by a grinding machine such as a dicing saw, it is possible to form a wall (activated section), the height of which is 450 $\mu$m and the thickness of which is 60 $\mu$m, as shown in FIG. 7(*a*). In this way, it is possible to form a space to define the pressure chamber 10 between the walls.

The electrode is formed in a specific portion on each wall. Concerning the method of forming the electrode, portions which are not subjected to plating are previously covered with resist, and other portions are subjected to plating (Au, Ni, Cr and Pt) while the thickness of the plated layer is controlled in accordance with the plating speed. Formation of the electrode is not limited to the above specific method, but it is possible to use the methods of vapor-deposition or spattering.

The pressure chamber 10 is formed when the upper end portions of the walls adjacent to each other are connected with the connecting member (roof) 9 as illustrated in FIGS. 5 and 6. This connecting member 9 is made of SUS (stainless steel) or glass. When the connecting member 9 is made to adhere to the upper end portion of the wall, it is possible to use an adhesive member 12 having a high anti-organic solvent property such as adhesive and thermal fusion film.

When the connecting member 9 is connected to each pressure chamber 10, it is possible to use a method by which the connecting member 9 is individually made to adhere to each pressure chamber 10. However, as shown in the first and the second example, one piece of connecting member 9 may be made to adhere onto one surface of the piezoelectric element in which the walls have already been formed, and then the connecting member 9 may be cut into a predetermined shape.

The nozzle plate 11 having nozzle holes 12 corresponding to the individual pressure chambers 10 is joined to a member (piezoelectric element) in which the pressure chambers 10 are formed, as illustrated in FIG. 4. The nozzle plate is formed in such a manner that a plate of SUS (stainless steel) is subjected to press-forming, Ni-electrocasting or resin molding, or alternatively a film of PET, PES or PEN having a high anti-organic solvent property is subjected to laser beam machining. When the nozzle plate 11 is joined to the piezoelectric element, an adhesive agent having a high anti-organic solvent property, heat fusion film or DFR is used.

It is possible to form the pressure chamber side, into which ink is fed, in the same manner as that of the nozzle plate 11. Alternatively, the following method of forming an ink feed passage (not shown) may be adopted. Grooves are formed on the side of the piezoelectric element to which ink is fed, and a member to tightly close the pressure chamber 10 is joined so that the grooves cannot be closed.

When a common ink feed passage member surrounding each ink feed passage is made to adhere, it becomes possible to feed ink from an ink tank (not shown) to each pressure chamber.

The electrode of each piezoelectric element is taken out as follows. A groove is formed on the surface onto which the nozzle plate 11 is made to adhere, corresponding to each groove (pressure chamber 10, space 7). After that, plating is conducted. In this case, sputtering or vapor-deposition may be applied. However, in the above circumstances, the electrode formed in the pressure chamber 10 and the electrode formed in the space 7 are short-circuited with each other. Therefore, a redundant plated player is removed by means of lapping. Due to the foregoing, the above electrodes can be electrically insulated from each other.

Figure 8:
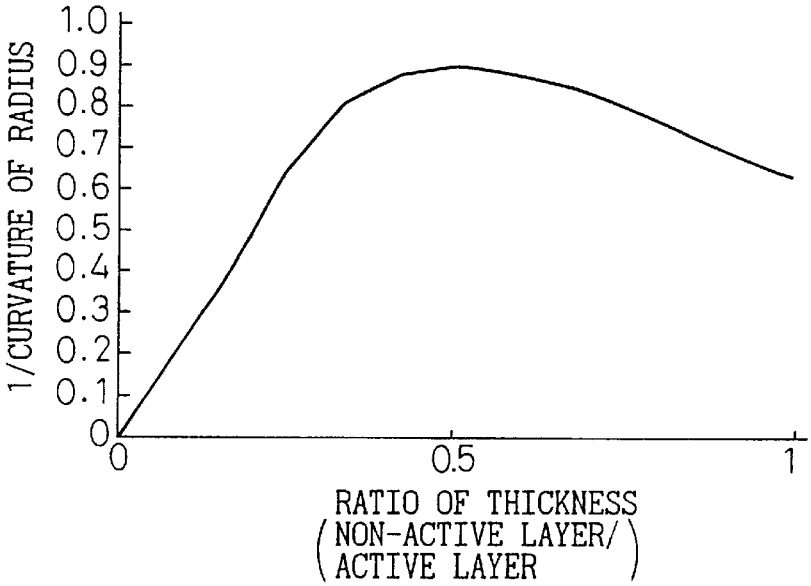
FIG. 8 is a graph showing a relation between the ratio of thickness of the bimorph layer and the curvature of radius.

FIG. 8 is a graph showing a relation between the ratio of the thickness of an unactivated layer (piezoelectric element) to the thickness of an activated layer (conductor) and the radius of curvature. That is, on the graph, a value of 1/(radius of curvature) and a ratio of the thickness of an unactivated layer to the thickness of an activated layer are calculated. In this case, the modulus of longitudinal elasticity of the activated layer is set at $60\times10^{10}$ (N/m$^2$), and the modulus of longitudinal elasticity of the unactivated layer is set at $200\times10^{10}$ (N/m$^2$). As described above, when the pressure chamber is made by forming the groove in the piezoelectric element, a thick electrode is provided on the wall on the pressure chamber side by means of plating, and a thin electrode is provided on the wall on the opposite side. Due to the above arrangement, a difference of contraction is caused between both sides of the piezoelectric element. Therefore, the bimorph effect is caused, and the wall of the piezoelectric element is curved inside, so that an amount of contraction of the pressure chamber can be increased.

Under the condition that the electric field intensity is constant, the radius of curvature is in inverse proportion to the piezoelectric constant $d_{31}$ and in proportion to the thickness. Under the condition that the voltage is constant, the radius of curvature is in inverse proportion to the piezoelectric constant $d_{31}$ and in proportion to the square of the thickness. Therefore, it is possible to design in such a manner that the amount of contraction is multiplied by several times. The result of calculation conducted to find a relation between the reciprocal of a radius of curvature and the ratio of thickness (electrode/piezoelectric element= unactivated layer/activated layer) is shown on the graph of FIG. 8, wherein the electrode, that is, the unactivated layer is nickel, the modulus of longitudinal elasticity of the piezoelectric element is $60\times10^{10}$ (N/m$^2$), and the modulus of longitudinal elasticity of nickel is $20\times10^{10}$ (N/m$^2$). When the ratio of thickness exceeds 0.05, the curve is remarkably bent. Therefore, the most appropriate ratio is 0.4 to 0.55 at which the curve is bent most favorably.

Figure 9:
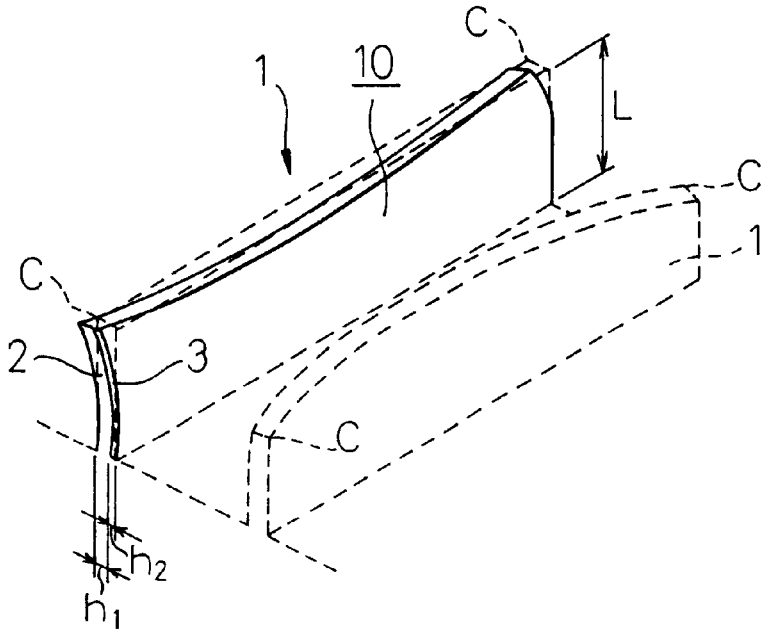
FIG. 9 is a schematic illustration showing a state of contraction of the pressure chamber caused by the bending deformation of the piezoelectric element in the case of contraction when the electrode on one side of the wall is made thick.

In the case of deformation shown in FIG. 9, an amount of contraction is in proportion to the cube of height L, and the depth b. Accordingly, only when the height L is extended a little, it is possible to shorten the length while the amount of contraction is maintained at a predetermined value. When the pressure in the pressure chamber is increased, the wall is pushed backward. In this case, the rigidity of the wall is in proportion to the cube of the thickness. Therefore, when the wall thickness is small, pressure is lowered. Design is conducted while consideration is given to the above. However, since an amount of contraction is increased by the bimorph effect, the degree of freedom of design is increased. As a result, it becomes possible to provide a piezoelectric pump, the amount of contraction of which is large at high pressure.

It is possible to form the walls of the piezoelectric element arranged on both sides of the pressure chamber 10 at the stage of mold formation before firing the piezoelectric element, however, in order to form fine walls with accuracy, it is preferable to form the walls, by means of grooving such as grinding conducted by a dicing saw, after the completion of firing the piezoelectric element.

After that, the electrode is made to adhere by means of spattering. In this case, the method of electroless plating is effective. By pretreatment in which the surface active layer is provided, it is possible to form an electrode of uniform thickness on a non-metal piezoelectric element. In the case where the electrode is formed in this way, thicknesses of the electrodes provided on both sides of the wall of the piezoelectric element can be made different from each other by the following methods.

(1) Plating is conducted while one surface is covered with a mask.

(2) A film forming method having a directivity such as a method of vapor-deposition is used, and one of the surfaces is made to coincide with its direction.

(3) One of the groove surfaces is previously formed, and a thick plated layer is formed on the surface by means of plating. After that, the other of the groove surfaces is formed, so that a new surface of the piezoelectric element is exposed, and successively plating is continued. Then, the plated layer is doubled on the surface on which plating has already been conducted before. However, it is possible to make a difference of thickness between the two plated layers.

When a hard material is used for the piezoelectric element, deformation is caused as follows. In this case, the hard material is described below. A low electric field in the reverse direction is applied to a piezoelectric element which has once subjected to polarization, and a thick electrode is provided on the opposite side to the pressure chamber opposite to the examples shown in FIGS. 3 and 5. Due to the above arrangement, when an electric field is applied, the thickness of the piezoelectric element is reduced, and the dimension in a direction perpendicular to the polarization is increased. Accordingly, a deformation is caused, that is, the piezoelectric element protrudes outwards. Due to the foregoing, the volume of the pressure chamber is increased. When the electrodes are short-circuited so as to remove the electric charge, the pressure chamber is elastically contracted. In this case, the elastic returning force is high at the beginning stage, so that this type is advantageous when a high acceleration is required. This type is well known as a release type in the field of electromagnetic drive mechanisms.

FIG. 9 is a schematic illustration showing a state in which the compound plate-shaped member 1 to define both side walls of the pressure chamber 10 is deformed by the bimorph effect in the second example illustrated in FIG. 5.

Figure 10:
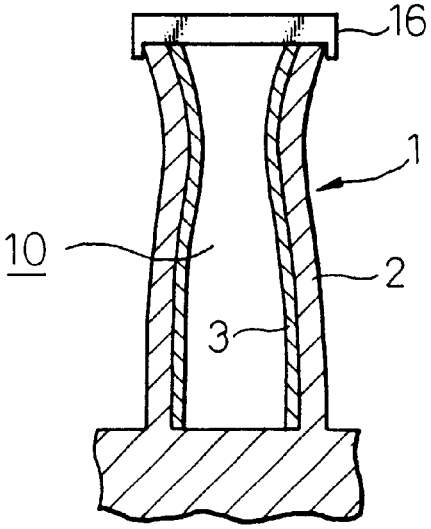
FIG. 10 is a cross-sectional view showing an example in which a pair of compound plate-shaped members are prevented from protruding outwards when a frame is provided at the opening portion of the compound plate-shaped members.

When the compound plate-shaped member 1 is deformed by the bimorph effect, the overall surface becomes a spherical surface. However, one surface (the lower surface in this example) is fixed onto the stationary wall 4 (shown in FIG. 5). Therefore, as illustrated in FIG. 9, the center is expanded inside, so that the pressure chamber 10 is contracted. However, in accordance with an increase of the inside pressure, the wall is given a force in the outwards direction, so that the edge is protruded outwards. Therefore, the aforementioned effect of contraction is decreased. For the prevention of this loss, it is effective to provide a frame 16 as illustrated in FIG. 10 so that the edge portion can be prevented from protruding outwards. It is preferable that the rigidity of an adhesive agent to join this frame 16 to the compound plate-shaped member 1 is approximately the same as the rigidity of the piezoelectric element. However, in the case of an organic adhesive agent, the rigidity is low, that is, the modulus of longitudinal elasticity is 1 to $4\times10^{10}$ (N/m$^2$). On the other hand, the rigidity of metal is higher than the rigidity of the piezoelectric element, wherein the modulus of longitudinal elasticity of the piezoelectric element is $60\times10^{10}$ (N/m$^2$). For example, the modulus of longitudinal elasticity of nickel is $20\times10^{10}$ (N/m$^2$), which is three times as high as the modulus of longitudinal elasticity of the piezoelectric element. For the above reasons, nickel plating is wide used and various techniques are provided for nickel plating. It is effective to use the technique of nickel plating so that the same effect as that of the frame 16 can be provided by nickel plating. When nickel plating is conducted, it is possible to use the method of electroless plating as well as the method of electrolytic plating. When the overall inside surface on the pressure chamber side is subjected to plating, it is possible to prevent the edge of the opening portion (portion C in FIG. 9) from protruding outwards. Therefore, it is possible to utilize almost all camber provided by the bimorph effect.

Figure 11B:
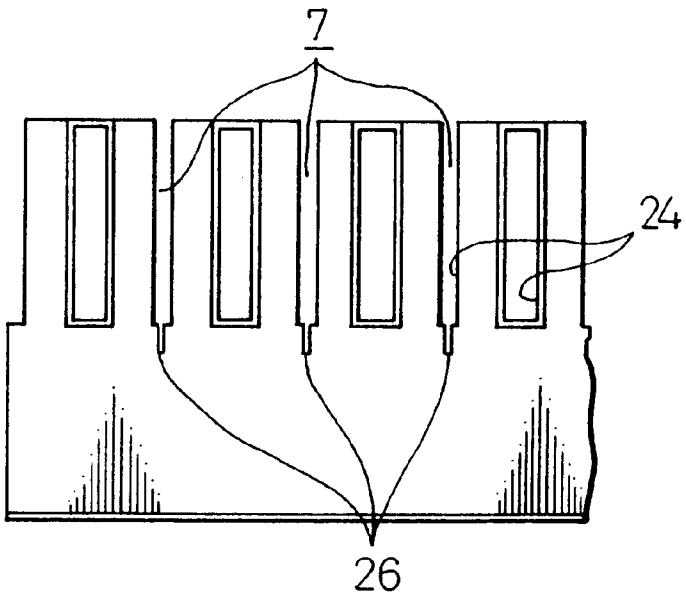
FIGS. 11(*a*) and 11(*b*) are views showing a process of plating by which the entire inner surface of the pressure chamber is covered with a plated layer.
Figure 11A:
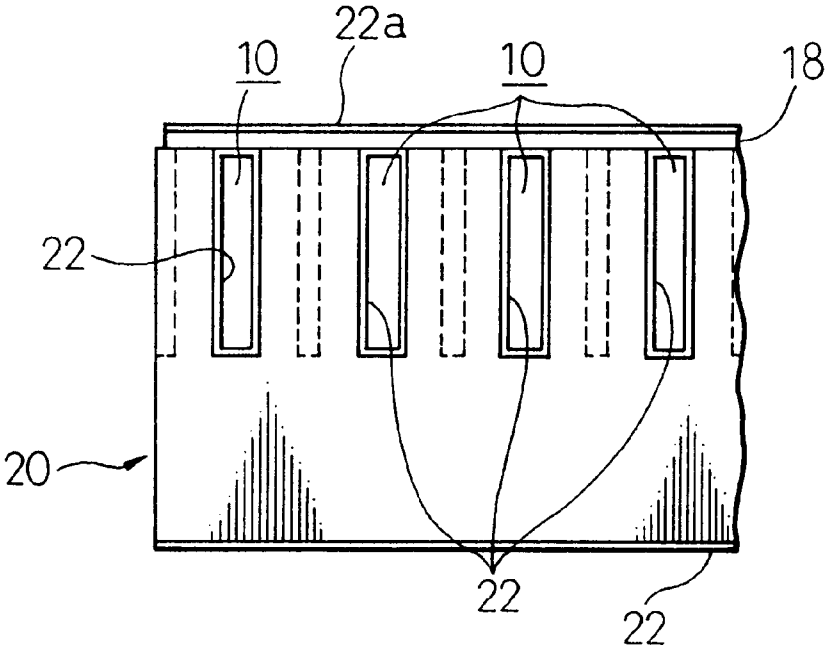

FIGS. 11(*a*) and 11(*b*) are views showing a manufacturing process. At the start of the manufacturing process, grooves 10 on the pressure chamber side are formed in the block 20 of the piezoelectric element. On the upper side, there is provided a removable film 18, for example, there is provided a resist film of acrylic material. An exposed surface is activated by applying a pretreatment agent of palladium. After that, plated layers 22, 22*a* are formed by means of electroless plating as shown in FIG. 11(*a*). In this way, the thick plated layer 22 is formed. Then, the resist film 18 is removed with solvent, and the plated layer on the groove side of the piezoelectric element is left, and the plated layer 22*a* outwards the resist film is broken and removed. After that, a separating groove to be formed into the space 7 is made, and plating is conducted again. Further, the surface on the viewer's side and the surface on the side opposite to the viewers side in the drawing are polished, so that the piezoelectric element is exposed and polished in the same manner as that of the upper surface. Then, the plated layer inside the pressure chamber and the plated layer outwards the pressure chamber (the plated layer in the space) are separated from each other and made into independent electrodes. When the groove 26 is formed by cutting the bottom surface of the separating wall, the outwards electrode in the space 7 is separated from the outwards electrode on the opposing side. Therefore, it becomes possible to drive each pressure chamber 10 independently.

The electrode of the adjacent unit can be separated by another method, and the manufacturing process can be reduced.

Figure 12A:
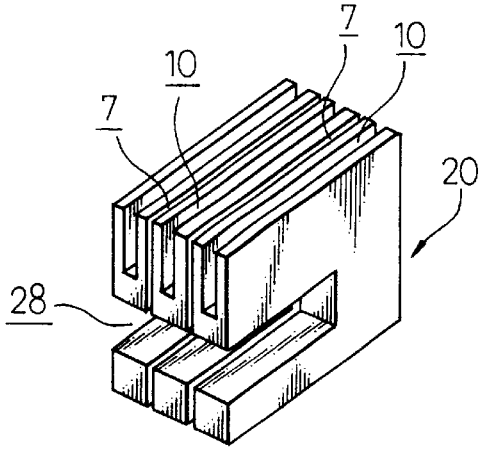
FIG. 12(*a*) is a view showing a state of dicing conducted on a member of material of the piezoelectric element in which grooves are formed in the transverse direction.
Figure 12B:
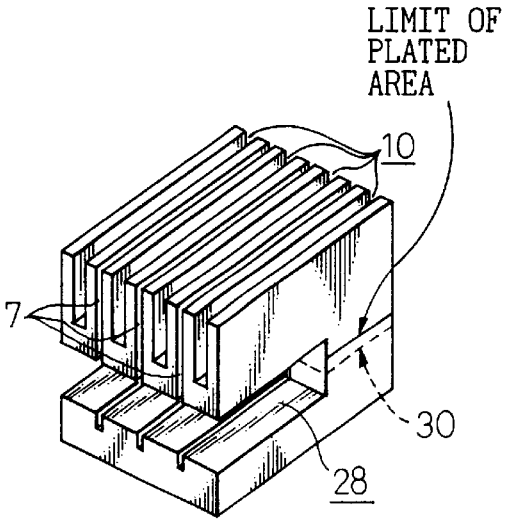
Figure 13A:
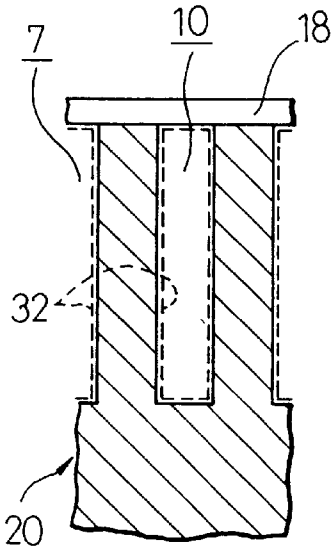
FIG. 13(*a*) is a view showing a process in which an opening end of the pressure chamber is covered with a film and plating is conducted inside the pressure chamber.
Figure 13B:
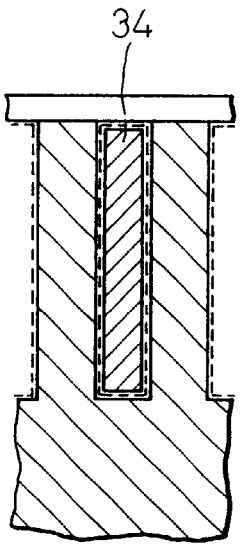
Figure 13C:
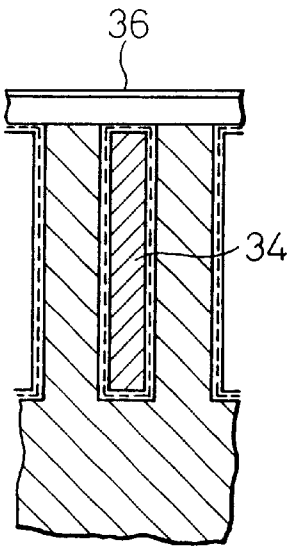
Figure 13D:
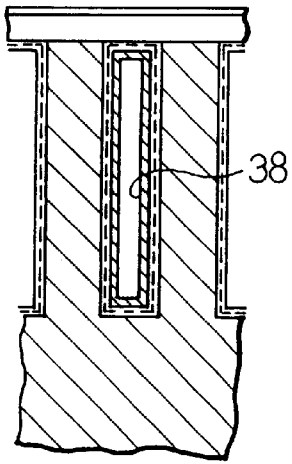
Figure 14A:
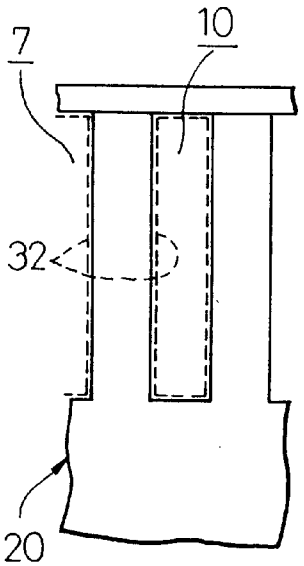
FIG. 14(*a*) is a view showing a process in which an opening end of the pressure chamber is covered with a film and plating is conducted inside the pressure chamber.
Figure 14B:
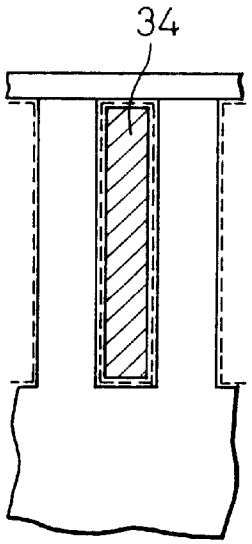
Figure 14C:
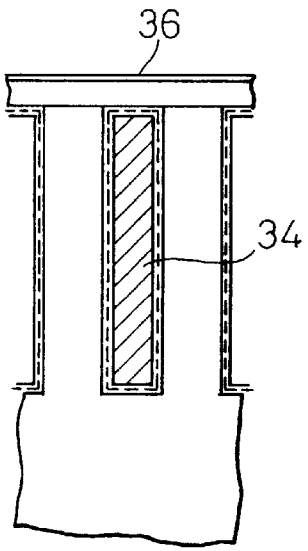
Figure 14D:
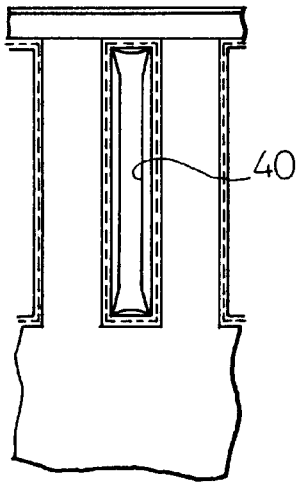

FIGS. 12(*a*) and 12(*b*) are views showing an example of the manufacturing process described above. In this case, a piezoelectric block 20 is used, in which a groove 28 extending in the transverse direction is previously formed. This groove 28 in the transverse direction is located on the lower side of the groove 10 which becomes a pressure chamber later. In the same manner as that shown in FIGS. 11(*a*) and 11(*b*), the processes include making a groove to be formed into a pressure chamber, coating a resist film, electroless plating, removing the resist film, making a separate groove to be formed into the space 7, and plating. In this case, when the separating groove to be formed into the space 7 is made, the depth of the separating groove is determined so that the depth can be located at a position lower than the dotted portion 30 used for separating each unit in the later process. After the completion of plating, the inside and the outwards electrode of the pressure chamber 10 are separated from each other by lapping. The outwards of the pressure chamber, that is, both surfaces of this separating groove 7 are connected with each other by the plated layer. After the nozzle plate 11 (shown in FIG. 4) has been joined to the compound plate-shaped member, this piezoelectric block 20 is cut on the dotted line 30. In this case, this piezoelectric block 20 may be bent and broken on the dotted line 30. Then, the piezoelectric block of each unit is separated, and the electrode is separated for each unit. Due to the foregoing, it is possible to solve the problems of interference caused by mechanical oscillation between the units adjacent to each other. That is, the problems caused in this multiple-unit can be solved.

FIGS. 13(*a*) to 13(*d*) are views showing a manufacturing method in which the manufacturing process is rationalized. According to this manufacturing method, processing is conducted as follows. First, the groove 10 to be formed into a pressure chamber and the groove 7 to be formed into a space are formed in the piezoelectric block 20. The resist film 18 is made to adhere onto an upper surface. The overall inner surface of the groove is subjected to plating, so that a thin substrate 32 can be formed (shown in FIG. 13(*a*)). Next, the groove to be formed into a pressure chamber is filled with wax 34 (shown in FIG. 13(*b*)). Further, the overall surface is covered with a plating resist 36. This is conducted for the purpose of preventing a plated layer from being deposited on the portion covered with resist (shown in FIG. 13(*c*)). Next, the end surface of the groove is exposed, and filling 13 such as wax filled in the groove to be formed into a pressure chamber is removed by being dissolved in solvent, so that the inner surface of the groove is exposed, and then plating is conducted on the inner surface of the groove so as to form a thick plated layer 38 (shown in FIG. 13(*d*)). In this connection, after the thick plated layer 38 has been provided, the resist 36 is finally removed. Due to the foregoing, the inner surface of the pressure chamber is covered with the thick plated layer, and the outwards is covered with the thin plated layer, that is, it is possible to form a pressure chamber capable of being deformed by the bimorph effect.

FIGS. 14(*a*) to 14(*d*) are views showing a manufacturing process in which electroplating is utilized. The process shown in FIGS. 14(*a*) to 14(*c*) are the same as that shown in FIGS. 13(*a*) to 13(*c*). In this example, after filling 34 such as wax filled in the groove to be formed into the pressure chamber has been removed by being dissolved in solvent, the inner surface of the groove is exposed, and electroplating is conducted on the inner surface of the groove so as to provide a thick plated layer 40 (shown in FIG. 14(*d*)). Due to the foregoing, the inner surface of the pressure chamber is covered with the thick plated layer, and the outwards is covered with the thin plated layer, that is, it is possible to form a pressure chamber capable of being deformed by the bimorph effect. In this example, electroplating is utilized for the manufacturing process. Therefore, thickness of the plated layer at the corner of the groove to be formed into a pressure chamber is small, and thickness of the plated layer at the center of the side of the groove is large. Due to the foregoing, deformation resistance of the plated layer formed at the corner, which blocks bending caused by the bimorph effect, can be reduced.

Figure 15:
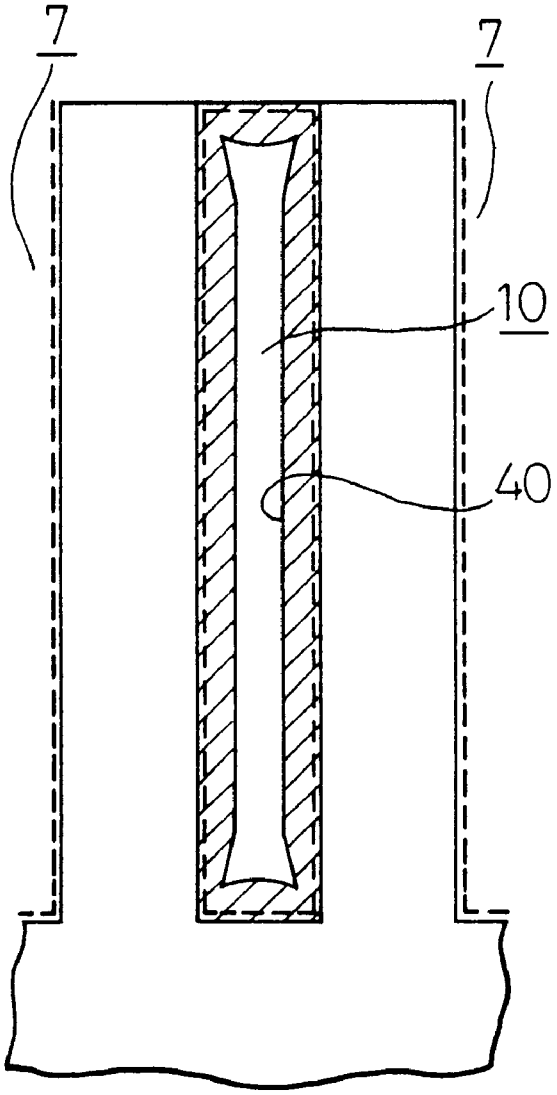
FIG. 15 is an enlarged view showing a final state of the pressure chamber from which resist has been removed in the process illustrated in FIG. 14.

FIG. 15 is an enlarged view of the plated layer provided on the inner surface of the groove to be formed into a pressure chamber manufactured by the method of the example described above. That is, FIG. 15 is an enlarged view of the inner surface of the groove from which resist has been finally removed. The thickness of the thick plated layer 40 formed at the corner (upper portion) by means of electroplating is smaller than that at the center, so that the deformation resistance at the corner can be reduced and thickness of the portion, which comes into contact with the piezoelectric element so as to provide the bimorph effect, is increased.

What is claimed is:

1. A method of manufacturing an ink jet head provided with: a plurality of pressure chambers arranged continuously; ink feed means for feeding ink into these pressure chambers; and ink ejecting means for ejecting ink from each pressure chamber via a nozzle, so as to feed and eject by a change in volume of each pressure chamber, the method of manufacturing the ink jet head, comprising the steps of:

forming a first metallic film on both opposite surfaces of at least one wall partitioning adjacent pressure chambers, wherein said at least one wall is one wall of a piezoelectric element to be deformed when a voltage is impressed;

removing the first metallic film formed on one of said both opposite surfaces of the at least one wall to form an exposed surface of the wall of the piezoelectric element; and forming a second metallic film formed on the exposed surface so that the first and second metallic films are formed on said both opposite surfaces of the at least one wall of the piezoelectric element, whereby the metallic films have thicknesses which are different from each other in a direction perpendicular to the at least one wall of the piezoelectric element.

2. A method of manufacturing an ink jet head provided with: a plurality of pressure chambers arranged continuously; ink feed means for feeding ink into these pressure chambers; and ink ejecting means for ejecting ink from each pressure chamber via a nozzle, so as to feed and eject by a change in volume of each pressure chamber, the method of manufacturing the ink jet head, comprising the steps of:

forming a plurality of parallel first grooves each defining the pressure chamber on a surface of a block of a piezoelectric element;

conducting a first plating on an inner surface of each of the first grooves to form a first plating layer thereon;

forming a plurality of second grooves each defining a space between the first grooves on the surface of the block; and conducting a second plating on an inner surface of each of the second grooves and on the first plating layer of each of the first grooves so that metallic films of the first and second platings are formed on both surfaces of a wall of the pressure chamber, whereby the metallic films have thicknesses which are different from each other in a direction perpendicular to the wall of the pressure chamber.

3. The method of manufacturing an ink jet head according to claim 2, wherein after forming the first grooves, in order to prevent an upper surface of the block of the piezoelectric element from being plated, covering the first grooves with a cover to be removed later, said conducting of the first plating forms a continuous hollow plated layer, and then after completing the first plating, removing the cover.

4. The method of manufacturing an ink jet head according to claim 2, further comprising a step of forming a third groove smaller than the second groove on a bottom of each of the second grooves after a completion of the second plating in order to cut the second plating.

5. A method of manufacturing an ink jet head provided with: a plurality of pressure chambers arranged continuously; ink feed means for feeding ink into these pressure chambers; and ink ejecting means for ejecting ink from each pressure chamber via a nozzle, so as to feed and eject by a change in volume of each pressure chamber, the method of manufacturing the ink jet head, comprising the steps of:

forming a first groove defining the pressure chamber in a piezoelectric block and a second groove defining a space chamber, wherein the first and second grooves are alternately formed in parallel with each other;

plating the first and second grooves to form a first plated layer;

filling one of the first and second grooves with removable filling;

covering an entire surface of the piezoelectric block so as to fill the other of the first and second grooves with resist, whereby both the first and second grooves are covered by the resist;

removing the filling;

plating said one of the first and second grooves to form a second plated layer thicker than the first plated layer; and removing the resist so that metallic films of the first and second plated layers are formed on both opposite surfaces of a wall of the pressure chamber, whereby the metallic films have thicknesses which are different from each other in a direction perpendicular to the wall of the pressure chamber.

6. The method of manufacturing an ink jet head according to claim 5, further comprising a step of electroplating in at least one portion of the plating process in which a thick metallic layer is formed, so that the thickness of the plated layer at the edge portion of the wall of the pressure chamber is smaller than the thickness of the plated layer at the center.

* * * * *